US006305152B1

(12) United States Patent
Myler et al.

(10) Patent No.: US 6,305,152 B1
(45) Date of Patent: Oct. 23, 2001

(54) HORSE CONTROL DEVICE

(76) Inventors: Ronald James Myler, 2045 Good Hope Rd.; Robert Rex Myler, 1903 Good Hope Rd., both of Marshfield, MO (US) 65706; Dale Dee Myler, Rte. #1 Box 268, Buffalo, MO (US) 65622

( * ) Notice: Subject to any disclaimer, the term of this patent is extended or adjusted under 35 U.S.C. 154(b) by 0 days.

(21) Appl. No.: 09/430,374

(22) Filed: Oct. 29, 1999

(51) Int. Cl.[7] ..... B68B 1/06
(52) U.S. Cl. ..... 54/7
(58) Field of Search ..... 54/6.1, 7, 8, 9

(56) References Cited

U.S. PATENT DOCUMENTS

D. 31,306 * 8/1899 Callis ..... 54/7
471,493 * 3/1892 Nichols ..... 54/7
750,199 * 1/1904 Kingid, Jr. ..... 54/9
1,660,490 * 2/1928 Koch ..... 54/7
3,831,345 * 8/1974 Stubblefield ..... 54/6.1
4,941,312 * 7/1990 Old, Sr. ..... 54/8

* cited by examiner

*Primary Examiner*—Charles T. Jordan
*Assistant Examiner*—Elizabeth Shaw
(74) *Attorney, Agent, or Firm*—Klarquist Sparkman, LLP

(57) ABSTRACT

A bridle bit and hackamore are disclosed. Each includes a pair of cheek pieces. Each cheek piece includes a lower rein ring and an upper headstall ring. A nose band and adjustable curb strap are joined at their ends to form a continuous loop. The loop is slidable through lower and upper slide rings on a purchase portion of each cheek piece. By adjusting the length of the curb strap, the loop can be adjusted to fit any horse. When the bit or hackamore are part of a bridle, and the reins are tightened, the loop applies simultaneous, even and predictable pressure to the horse's nose and curb.

23 Claims, 5 Drawing Sheets

60
48a
40a
38a
38a
44a
28a
46a
36a
41a
28a
44a
36a
34a
42a
26a
26a
8a
12a
42a
9
8a
22a
9
24a
22a
24a 80
48c
40c
38c
38c
44c
28c
46c
26c
36
41c
28c
44c
26c
36c
39c
34c
P
P
42c
22c
8c
42c
8c
22c
R
R
24c
24c

HORSE CONTROL DEVICE

FIELD OF THE INVENTION

This invention relates generally to a horse control or communication device such as a bridle bit or bitless bridle (hackamore).

BACKGROUND OF THE INVENTION

Bridles are placed on a horse's head and used by a rider to control a horse's movements or otherwise communicate commands to the horse. Generally speaking, a bridle includes the reins, bit, curb strap, nose band, and headstall, although the selection of the components that make up a particular bridle depends on several factors, including, for example, the sensitivity of the horse's mouth, the level of the horse's training, and the experience of the rider. Control or communication is achieved by pulling on the reins, which thereby transmit control pressure to various parts of the horse's head through the bit, curb strap, nose band and/or headstall, depending on the type of bridle used. Bridle bits and hackamores are the control or communication elements of bridles through which control or communication pressure is transmitted to the desired portions of a horse's head. Such bits and hackamores are of many different types and are produced in numerous shapes and sizes. Most bridle bits and hackamores have certain common components, however. These common components typically include a pair of cheek pieces with rein rings for attaching the reins, and other rings for separate attachment of a curb strap or chain (hereinafter collectively referred to as a "curb strap"), nose band, and headstall. In a bridle bit, the cheek pieces would, in addition, include means, such as cheek rings, for either fixedly or slidably attaching the opposite ends of a mouthpiece to the cheek pieces. Thus, by tightening the reins, the rider transmits control or communication pressure to the desired pressure points of the horse's head through the cheek pieces and their connected components. In the case of a bridle bit, the cheek pieces may transmit control pressure through the mouthpiece, curb strap and nose band to the horse's mouth, curb and nose, respectively. In the case of a hackamore, no mouth pressure is applied because of the absence of a mouthpiece. In addition, in either case poll pressure may be applied to the top of the horse's head through the head stall.

The basic principles for controlling a horse are generally the same for all types of bridles. Horses have a tendency to resist heavy steady pressure of the reins and generally respond more favorably to light intermittent pressure. For example, if a rider is signaling the horse to come to a halt by applying heavy pressure on the reins, the horse may ignore or try to resist the command. Thus, communicating effectively with a horse ideally requires different gradations of rein tension transferred predictably, simultaneously, and evenly to the multiple pressure points on the horse's head.

A major problem with existing bridle bits and hackamores is that their nose bands and curb straps do not necessarily apply predictable, simultaneous and even pressures to their respective pressure points on a horse's head when the reins are tightened because the nose band and curb strap operate independently of one another. This independent action results from the nose band and curb strap being separately affixed at their opposite ends to purchase portions of the cheek pieces. Also, because of their separate attachment to the cheek pieces, the nose band and curb strap may fit differently on the horse's head. Consequently, when the reins are tightened, the nose band may apply pressure before the curb strap, or more pressure than the curb strap, or vice versa, giving the horse confusing signals. Also, an undesirably high pressure may need to be applied by either the nose band or curb strap before the other applies any pressure because of the independent action and fit of these elements on the horse's head. The unpredictable, uneven, and independent application of pressure to the pressure points of a horse's head by the nose band and curb strap of existing combination bridle bits and hackamores unduly complicates control of and communication with the horse. For example, causing a horse to break at the poll, or come into the bridle, can be difficult with existing combination bits and hackamores.

For the foregoing reasons, there is a need for new and improved bridle bits and hackamores that overcome the foregoing and other disadvantages of the prior art.

SUMMARY OF THE INVENTION

The present invention seeks to overcome the foregoing problems of prior bridle bits and hackamores by providing an improved control or communication device for horses that may be applied to various types of bridle bits and hackamores, especially those of the combination type. More specifically, the present invention includes an improved combination bridle bit or hackamore that seeks to improve communication with and control of a horse by providing means for applying at least curb pressure and nose pressure simultaneously, evenly, consistently, and in a controlled manner when the reins of the bridle are tightened.

Moreover, important objects and advantages of the present invention are that it provides a combination bit or hackamore that can be easily adjusted to fit any horse, and that is self-adjusting when fitted on a given horse. These features facilitate control of a horse to break at the poll or come into the bridle.

In its broad aspects, the invention accomplishes these objectives and provides these advantages in a bridle bit or hackamore that includes a curb strap and nose band that are interconnected to form a continuous loop. The nose band-curb strap loop is slidably connected to a pair of cheek pieces in a manner such that when the reins of the bridle are tightened, simultaneous, even and predictable pressures are applied to the curb and nose of the horse. The loop is preferably adjustable so that the curb strap and nose band portions can be properly fitted to the head of a particular horse. When thus fitted, the nose band and curb strap become self-adjusting, ensuring the application of not only simultaneous, but also even, predictable and repeatable pressures to the curb and nose of the horse's head. Moreover, these pressures are proportional to the amount of tension applied to the reins, so that, if desired, nose and curb pressure can be precisely controlled and increased gradually, if desired.

The invention is adaptable to combination bridle bits, hackamores and cheek pieces of many different styles. When a bridle bit or hackamore incorporating the invention is combined with a head stall, the invention enhances the application of simultaneous curb, nose and poll pressure to the horse's head. Furthermore, when the invention is incorporated in a bridle bit combined with a head stall, rein tension will apply simultaneous pressure at four pressure points, the mouth, nose, curb and poll of the horse's head.

In one illustrated embodiment of the invention, a bridle bit includes a pair of cheek pieces, each with a cheek ring and a shank extending downwardly from the cheek ring and terminating at its lower end at a rein ring. A purchase extends upwardly from the cheek ring and terminates in a headstall ring. An interconnected nose band and curb strap forms a loop that slidably extends through a lower slide ring and upper slide ring of each purchase. The curb strap portion of the loop is adjustable so as to adjust the size of the loop and thus the fit of both the curb strap and nose band on a horse. An adjustable headstall strap may be connected to each headstall ring to extend over a horse's poll. A mouthpiece is slidably connected at its opposite ends to the cheek rings of the cheek pieces. A protruding stop on the forward portion of each cheek ring limits sliding movement of the mouthpiece on the cheek rings when such rings are rotated through tightening of the reins of a connected bridle. Thus, when a bridle including such bit is installed on a horse and the reins are tightened, controlled pressure is applied simultaneously through the cheek rings and connected mouthpiece, nose band, curb strap and headstall strap to the four corresponding pressure points of the horse's head. The nose band and curb strap loop, and its slidable connection to the purchases of the cheek pieces, provide for an even and simultaneous application of pressure to the horse's curb and nose, while at the same time control pressure is applied to the horse's mouth and poll.

The foregoing and other objects, features and advantages of the present invention, as well as additional embodiments thereof, are described further in the following detailed description, which proceeds with reference to the accompanying drawings.

DETAILED DESCRIPTION

Figure 1:
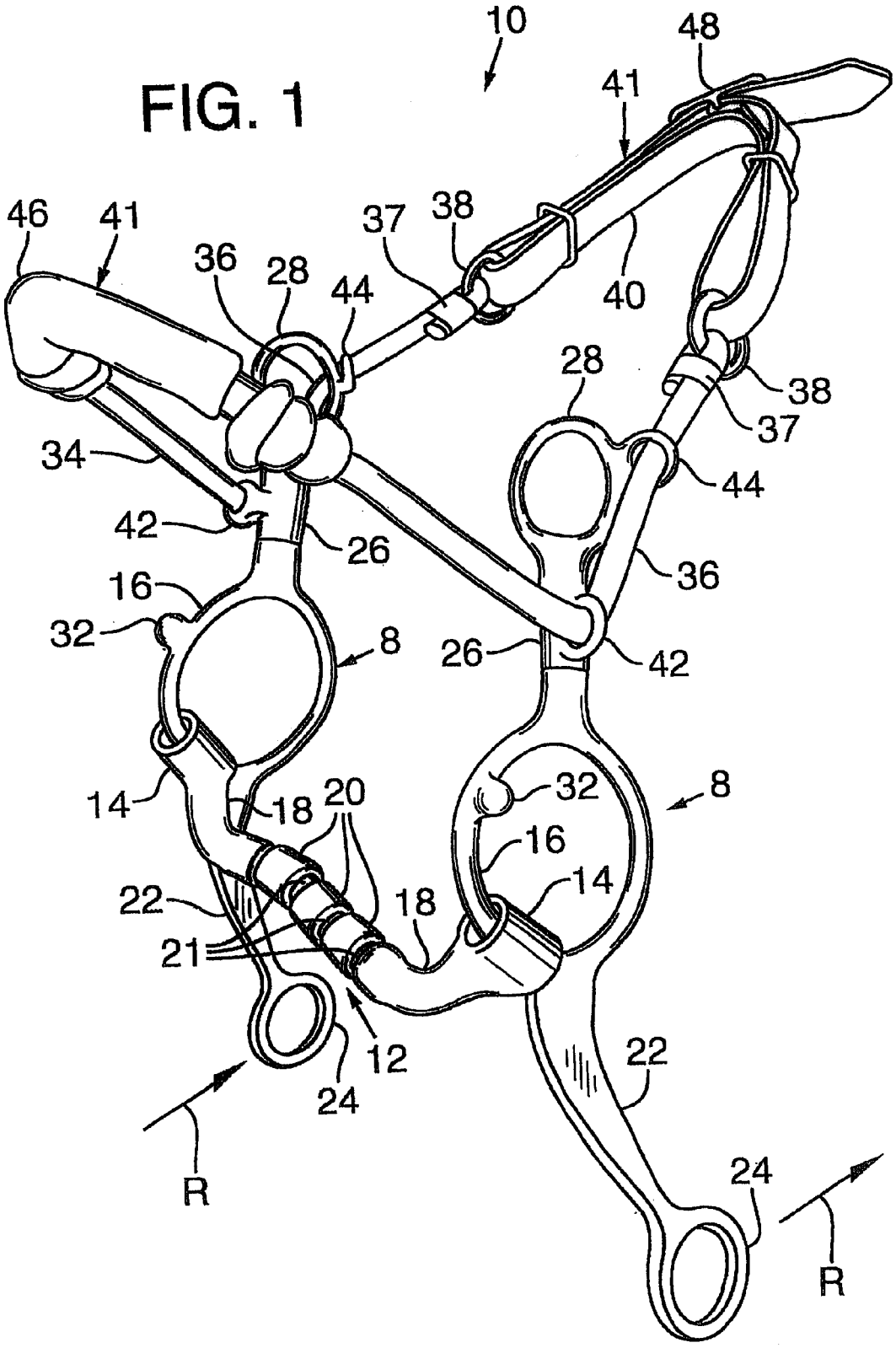
FIG. 1 is a perspective view of a bridle bit embodying the present invention.
Figure 2:
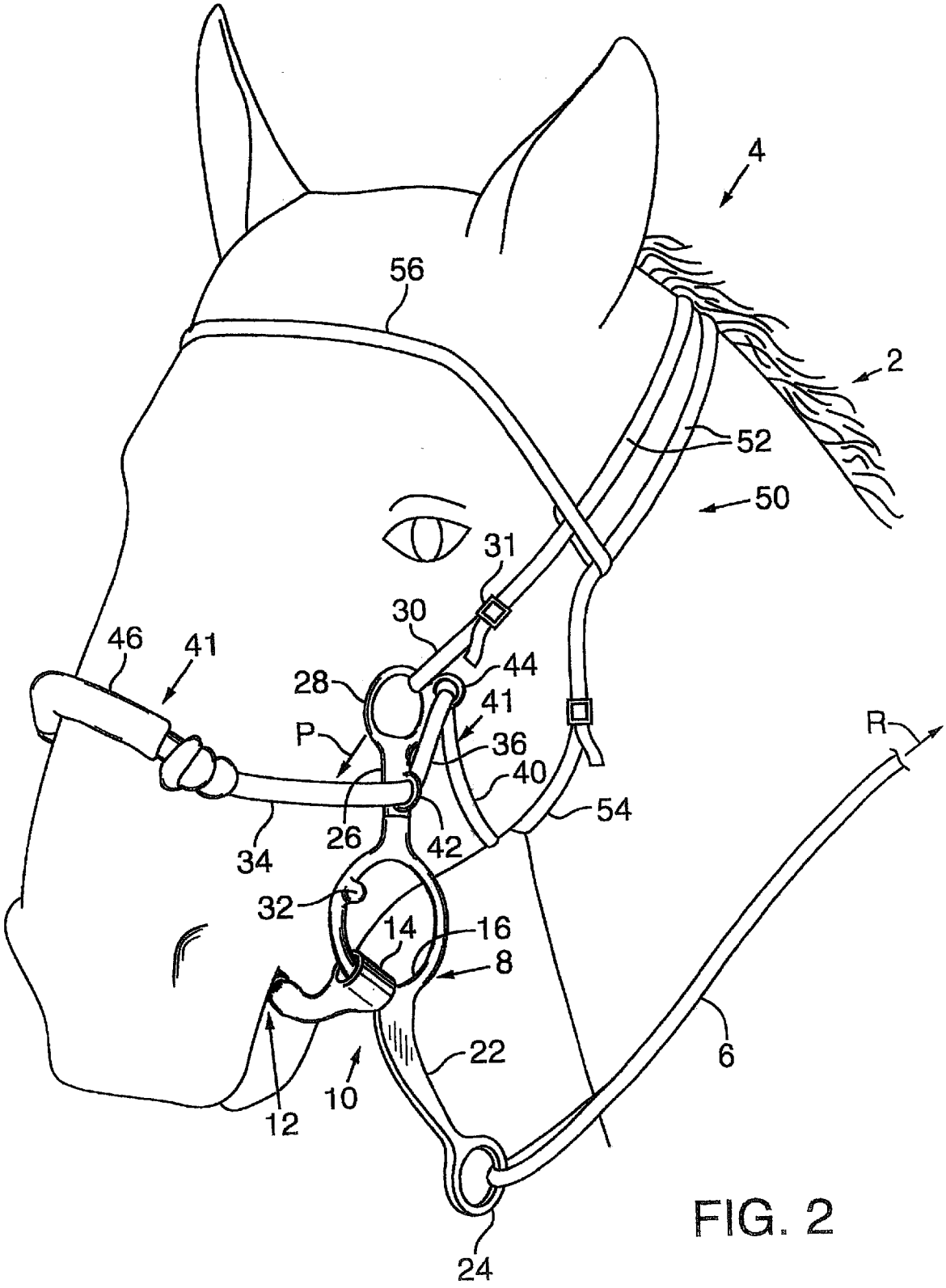
FIG. 2 is a perspective view of a bridle mounted on a horse's head and incorporating the bridle bit of FIG. 1.

As disclosed in FIGS. 1 and 2, a bridle bit 10 comprises left and right cheek pieces 8 which reside closely adjacent the cheeks of a horse 2 when bit 10 is connected to a headstall 50 and placed on the horse's head (FIG. 2). Each cheek piece 8 includes a cheek ring 16 for slidably receiving an end of a mouthpiece 12. A shank 22 extends downwardly from each cheek ring 16 and terminates at a rein ring 24 for connecting a rein 6 of a bridle 4, shown generally in FIG. 2. A purchase member 26 extends upwardly from each cheek ring 16 and terminates at its upper end in a headstall ring 28. Each cheek ring 16 includes a protruding stop 32, mounted forwardly on each cheek ring and positioned proximate a plane defined by an upper portion of a horse's mouth, or stated differently, by the lower limit of the horse's upper jaw.

Mouthpiece 12 is sized and shaped to be received in the horse's mouth and has laterally extending opposite outer end portions 18 which terminate at rings 14. Each mouthpiece ring 14 is slidably connected to a cheek ring 16 below stop 32 and above shank 22. The mouthpiece 12 may comprise any known type, such as a unitary one-piece mouthpiece, or the jointed mouthpiece shown having two or more interconnected mouthpiece members 18 forming a series of articulated joints.

Each purchase member 26 includes a lower slide ring 42 positioned below headstall ring 28 and on the outside of the purchase. An upper slide ring 44 is affixed to the purchase above the lower slide ring, also toward the outside of the purchase, on a rearward portion of the headstall ring.

A nose band 34 has opposite end portions 37 connected at 38 to the opposite end portions of a curb strap 40, thereby forming a continuous nose band-curb strap loop 41 that extends over a horse's nose and under the horse's chin and is slidably connected to the purchase members 26 through slide rings 42, 44. Portions 36 of nose band 34 slidably extend through both lower slide ring 42 and upper slide ring 44 of each purchase member 26. In the illustrated embodiment, end portions 37 of the nose band 34 are coupled to the ends of the curb strap via metal connector rings 3.

The nose band 34 comprises a strong but flexible material, such as rope. Nose band 34 has a center portion covered by a leather sleeve 46. Sleeve 46 is preferably curved to conform generally to a horse's nose and serves to protect the horse's skin from chaffing by nose band 34. The nose band 34 may also be constructed of a different material, such as a flexible leather strap or a fabric-covered metal chain.

Curb strap 40 comprises a leather strap. The strap extends through the metal connector rings 38 at each end portion 37 of nose band 34. Alternatively, a metal curb chain or a fabric-covered curb chain may be used in place of leather curb strap 40. Curb strap 40 includes means for adjusting the length of the curb strap, and thus the effective size of the curb strap-nose band loop 41 and the effective length of the nose band itself. Such an adjustment means in the illustrated embodiment comprises the adjustment buckle 48.

The described bridle bit is used in the following manner, referring especially to FIG. 2. Bridle bit 10 becomes part of the bridle 4 when it is attached via its cheek pieces 8 to the reins 6 at rein rings 24 and to the headstall 50 by headstall strap 30 at headstall rings 28.

When bridle 10 is placed on a horse's head as shown in FIG. 2, nose band 34 and curb strap 40 fit around the horse's muzzle. That is, the curb strap portion 40 of the continuous loop 41 extends under the horse's chin or curb and the nose band portion 34 extends over the horse's nose. Because of the placement of lower and upper slide rings 42, 44 on the purchase, the nose band is lower on the horse's muzzle than the curb strap, which is significant as explained below in describing use of the bridle bit of the invention. Because nose band 34 and curb strap 40 form continuous loop 41, adjustment of the curb strap with adjustment buckle 48 assures a proper fit for both components, and the loop can be adjusted to properly fit a horse's head of any size or shape.

A conventional headstall 50 may be used with bridle 10. The illustrated headstall 50 includes a crownpiece 52 which comprises two parallel straps extending behind the ears. Crownpiece 52 splits into a headstall strap 30 and a throatlatch 54 on each side of the horse's head. The headstall straps 30 are adjustable at buckle 31 and extend across the cheeks to connect to bridle bit 10 at each headstall ring 28. Throatlatch 54 extends downwardly and runs between the neck and the jaw. Headstall 50 also includes a browband 56 which is attached to crownpiece 52 and runs across the head in front of the ears.

In use, the described bridle bit operates as follows: When a rider is not applying any rein tension, mouthpiece 12 is slidable relative to the cheek rings 16 and is allowed to float within a horse's mouth. Similarly, no appreciable pressure is applied at the nose, curb or poll of the head. As a rider tightens, or pulls back on, both reins (indicated by arrows R) upward pulling force is applied to the lower ends of shanks 22. This tends to rotate the cheek pieces 8 roughly about the axes of cheek rings 16, moving the headstall rings 28 downwardly and forwardly relative to the horse's head. As this rotation occurs, mouthpiece 12 gradually increases downward pressure on the horse's mouth, while simultaneously the nose band 34 applies increasing downward pressure to the horse's nose and the curb strap applies increasing upward pressure to the horse's curb. Simultaneously, the downwardly moving headstall rings 28 pull headstall strap 30 and its connected crownpiece downward, applying increasing downward pressure at the poll. Continued rotation of cheek rings 16 cause stops 32 to engage mouthpiece rings 14, preventing the mouthpiece 12 from sliding over center on the cheek rings and thus releasing mouthpiece pressure. Thus, by gradually increasing rein tension, bridle bit I 0 will simultaneously and gradually increase control pressure at the four pressure points - at the mouth, nose, curb, and poll.

Because of the interconnection of curb strap and nose band and their slidable connection to the purchases of the cheek pieces, these components will self-adjust and apply substantially equal pressures at the curb and nose. Moreover, because of the positioning of the lower and upper slide rings 42, 44 on purchases 26, whereby curb strap 40 is positioned on the horse's curb or chin above the nose band 34 across the horse's nose, the upward pressure applied high under the curb or chin combined with the downward pressure applied lower across the nose, produces a force couple, or leveraging torque, that encourages the horse to break at the poll, or come into the bridle.

Once stops 32 take effect, bridle bit 10 simultaneously applies a downward pressure through the nose band 34, an upward pressure through curb strap 40, and a downward pressure through mouthpiece 12. As the purchase members 26 continue to rotate forward, the circumference of the nose band-curb strap loop 41 decreases about the horse's muzzle, thereby gradually and evenly increasing downward pressure on the nose and the upward pressure on the chin. At the same time, downward pressure of the mouthpiece 12 increases, as does downward pressure of the headstall strap at the poll. As a result of rein tension simultaneously acting on all four pressure points, the horse is likely to immediately recognize the command signal and quickly respond by lowering its head and flexing at the poll.

Because the pressure at all four points increases at a gradual rate, the horse will feel only the slightest pressure when light rein tension is applied. If the rider lets up on the reins as soon as the horse responds, the amount of pressure felt by the horse is minimized. After rein tension is released, downward pressure on the horse's mouth is immediately relieved and the mouthpiece 12 is able to freely move within the mouth. The present embodiment, therefore, utilizes leverage action to apply simultaneous pressure to the four pressure points, but does so without subjecting the horse to unnecessary and excessive pressure. Thus, this invention allows a rider to accurately and consistently control the intensity of control pressure by varying the backward pull of the reins. As a result, riders may find this invention to be helpful in preventing the inadvertent use of excessive rein tension, thus minimizing the potential for injury to horse and rider.

FIG. 3 Embodiment

Figure 3:
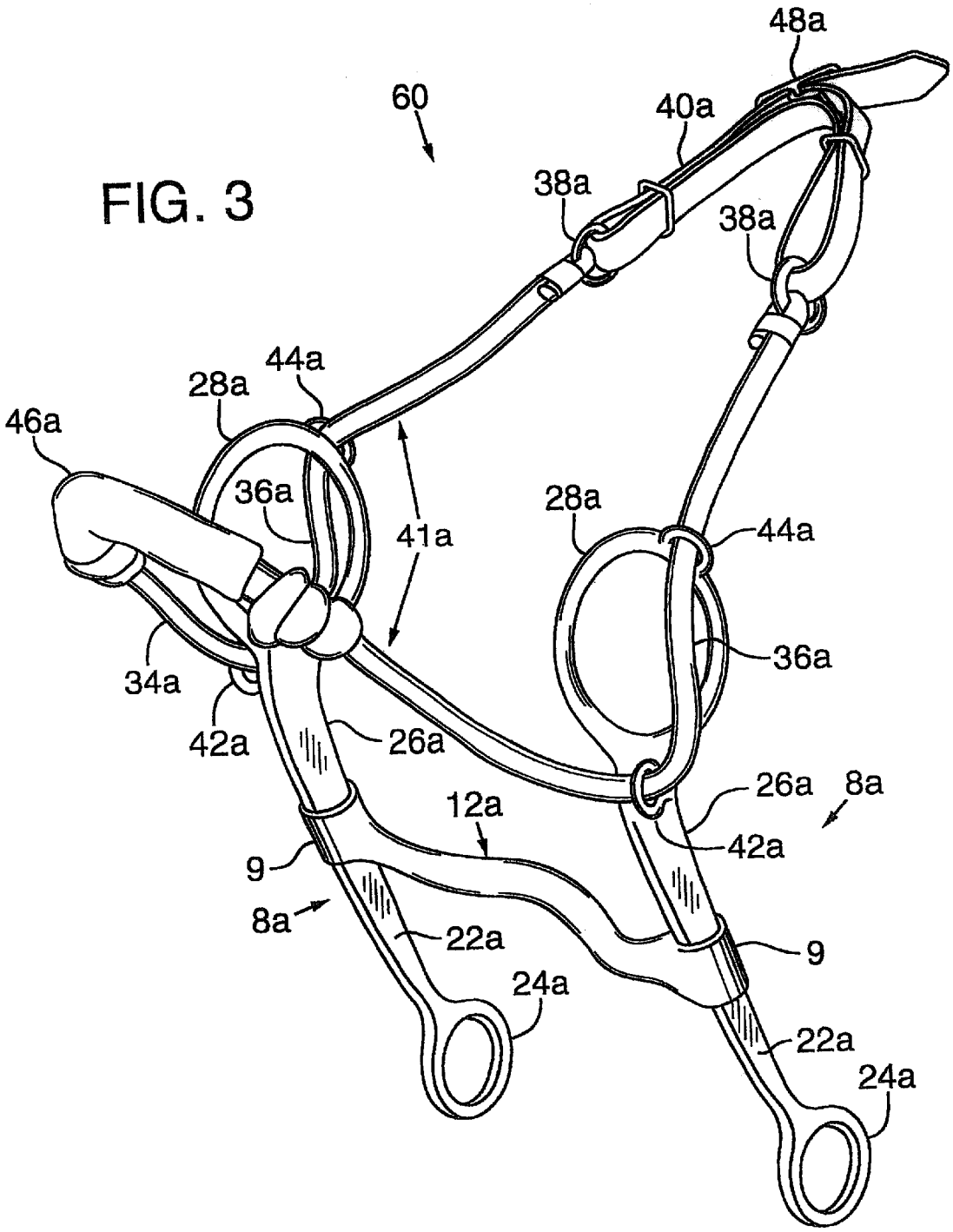
FIG. 3 is a perspective view similar to that of FIG. 1 but showing another type of bridle bit embodying the present invention.

According to a second embodiment of the present invention, as shown in FIG. 3, a bridle bit 60 comprises left and right cheek pieces 8a which reside closely adjacent the cheeks of a horse when the bridle bit 60 is placed on the horse's head. Each cheek piece 8*a* includes a downwardly extending shank 22*a* terminating in a rein ring 24*a* for connecting a rein (not shown) and an upwardly extending purchase member 26*a* terminating in a headstall ring 28*a*. A one-piece rigid mouthpiece 12*a* is affixed at its opposite ends to the cheek pieces at joints 9. Each purchase member 26*a* includes a lower slide ring 42*a* and an upper slide ring 44*a* for slidably receiving a nose band-curb strap loop 41*a*. The lower slide rings 42*a* are mounted on the outside of each purchase member 26*a*, below headstall slot 28*a*. Upper slide rings 44*a* are mounted on the rearward periphery of each headstall ring 28*a* and extend rearwardly and outwardly.

Unlike the FIG. 1 embodiment, the cheek pieces of this embodiment do not include cheek rings.

As in the embodiment of FIG. 1, this embodiment includes a nose band 34*a* and curb strap 40*a* joined in the same manner as previously described to form loop 41*a*. Curb strap 40*a* includes a buckle 48*a* for adjusting its length and thus the size of loop 41*a* and effective length of nose band 34*a* for proper fit of the nose band and curb strap on a particular horse. Nose band 41*a* includes a sheath or cover 46*a* for protecting the horse's nose.

similar to the bridle bit of FIG. 1, this embodiment is capable of simultaneously applying, at a gradually increasing rate, a downward pressure through the nose band 34*a*, an upward pressure through the curb strap 40*a*, and a downward pressure through the mouthpiece 12*a*, by applying gradually increasing rein tension. When a conventional headstall is used as previously described, rein tension also applies simultaneous poll pressure to the horse's head, as in the embodiment of FIG. 1.

FIG. 4 Embodiment

Figure 4:
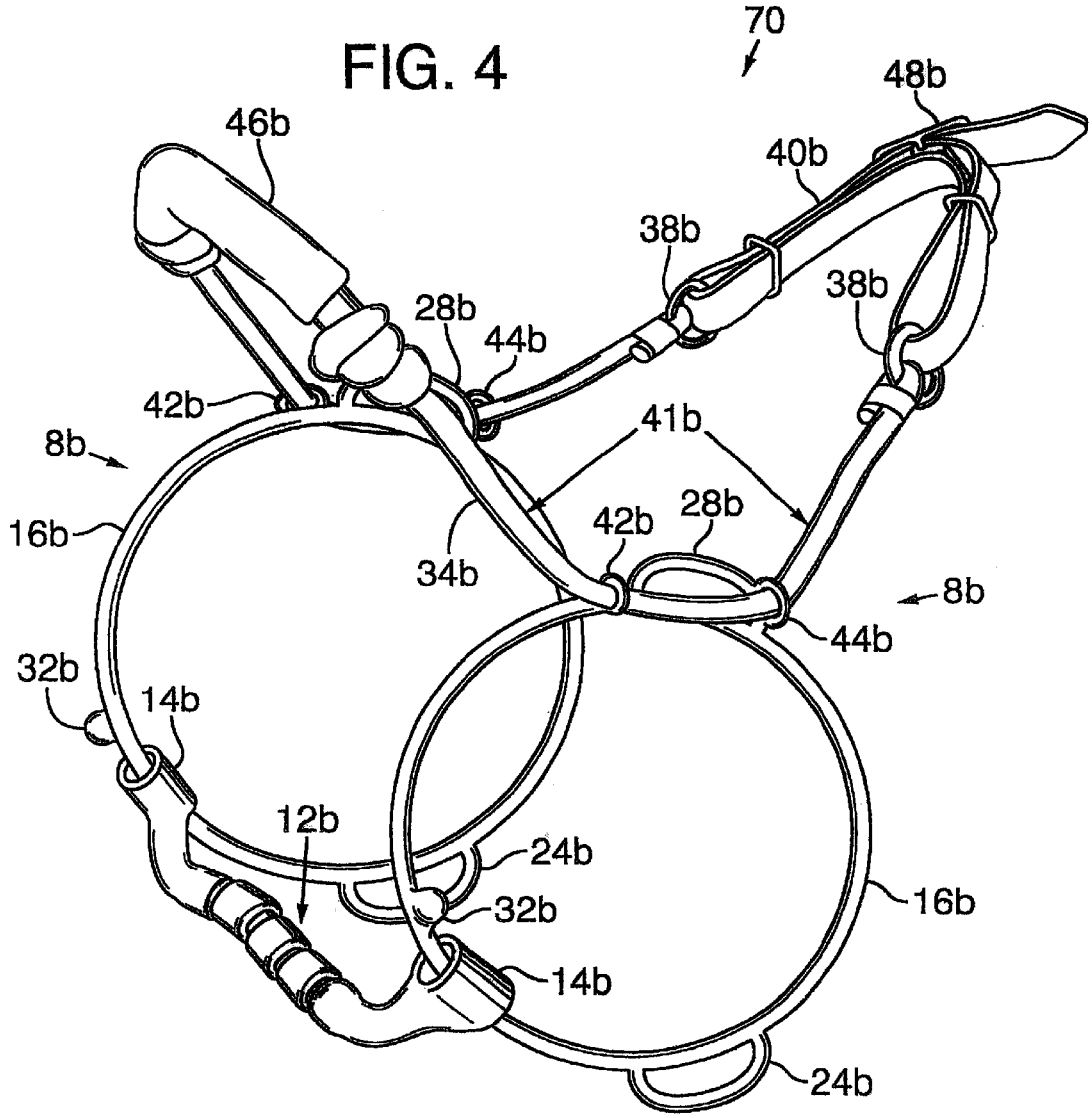
FIG. 4 is a perspective view of yet another type of bridle bit embodying the present invention.

A third embodiment of the present invention is shown in FIG. 4. It includes a bridle bit 70 comprising left and right cheek pieces 8*b*. Each cheek piece 8*b* includes a cheek ring 16*b*, a rein ring 24*b* attached to a lower portion of the rein ring, and a headstall ring 28*b* attached to an upper portion of the cheek ring. Each cheek ring 16*b* includes a stop 32*b* mounted on a forward portion of the cheek ring and positioned as described with respect to the stops 32 of FIG. 1.

The upper rim of each cheek ring mounts a lower slide ring 42*b* forwardly of headstall ring 28*b* and preferably extending outwardly from the cheek ring. An upper slide ring 44*b* is mounted on a rearward portion of each headstall ring 28*b* and extends outwardly therefrom. Thus, in this embodiment the upper portion of each cheek ring becomes a purchase portion and the lower portion of each cheek ring becomes a shank portion.

A mouthpiece 12*b* similar to that of FIG. 1 has end rings 14*b* that slidably connect the opposite ends of the mouthpiece to the lower, forward portions of the cheek rings below stops 32*b*.

This embodiment includes a nose band 34*b* and curb strap 40*b* like those of the embodiments of FIGS. 1 and 3, and joined in the same manner to form the loop 41*b* adjustable via curb strap buckle 48*b*. As in the prior embodiments, the nose band end portions are threaded first through the lower slide rings and then through the upper slide rings before joining the ends of the curb strap at connector rings 38*b*. This embodiment functions in a manner similar to the prior embodiments, except with a reduced amount of leverage upon tightening of the reins because of the absence of discrete, projecting shank and purchase portions.

FIG. 5 Embodiment

Figure 5:
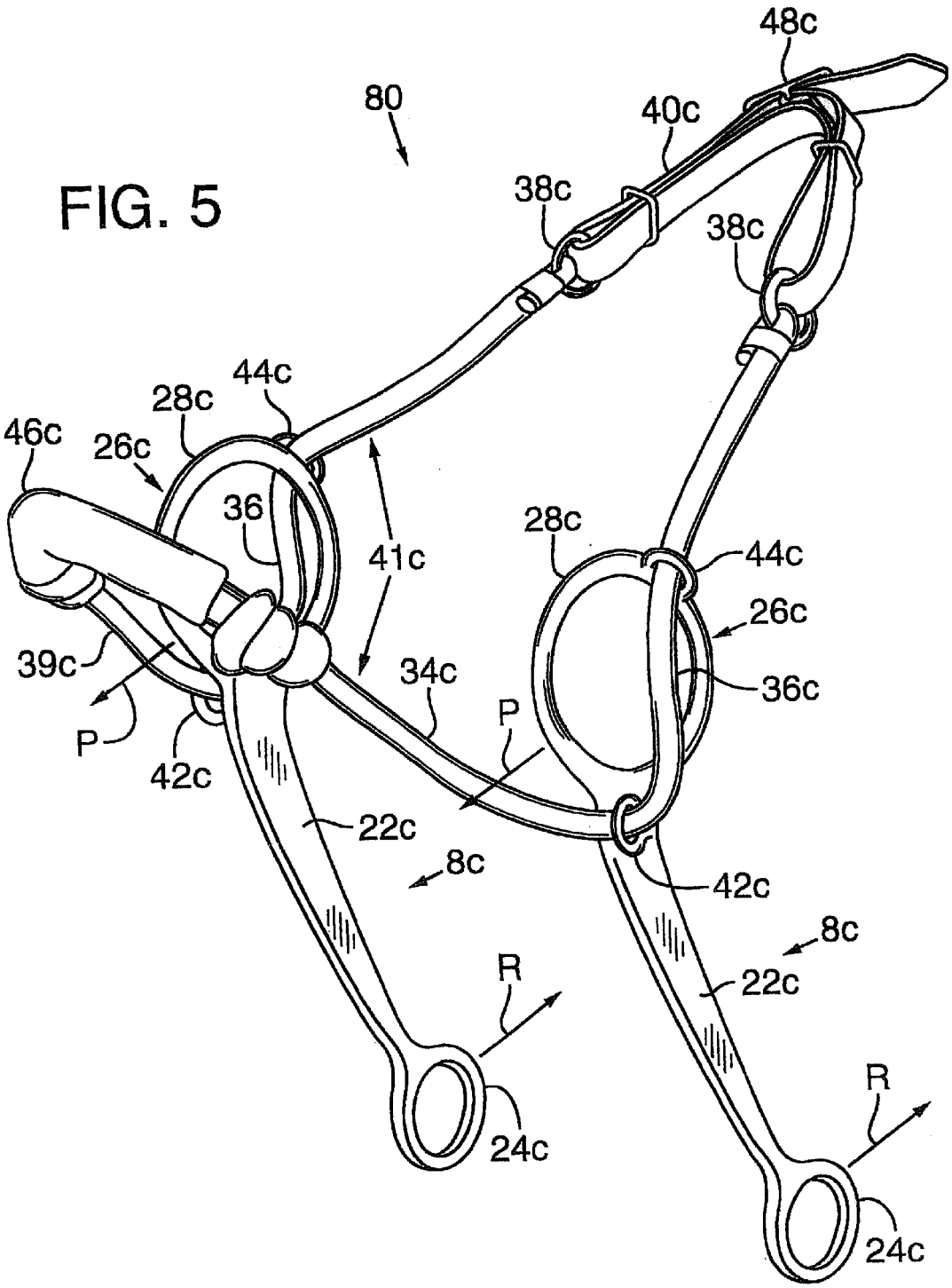
FIG. 5 is a perspective view of a bitless, or hackamore, bridle embodying the present invention.

In yet another embodiment of the present invention, shown in FIG. 5, a hackamore, or bitless bridle, 80 comprises left and right cheek pieces 8*c*. Each cheek piece 8*c* has a downwardly extending shank 22*c* terminating at its lower end in a rein ring 24*c*. The upper end portion of the cheek piece is an upward continuation of the shank and forms a purchase portion 26*c* which terminates in a headstall ring 28*c*. This embodiment includes no cheek rings and no mouthpiece. purchase portion 26*c* which terminates in a headstall ring 28*c*. This embodiment includes no cheek rings and no mouthpiece.

Each purchase portion 26*c* includes a lower slide ring 42*c* below headstall ring 28*c* and on the outside of the cheek piece. An upper slide ring 44*c* is mounted on an upper rear portion of each headstall ring 28*c* and extends outwardly therefrom.

A nose band 34*c* and adjustable curb strap 40*c* as previously described are joined as previously described to form a loop 41*c*. The end portions 36*c* of the nose band are threaded first through the lower slide rings and then through the upper slide rings before joining the curb strap at connector rings 38*c*. An adjustment buckle 48*c* on the curb strap adjusts the nose band-curb strap loop to fit a particular horse.

Because the embodiment of FIG. 5 does not incorporate a mouthpiece, it can be used in situations where a horse does not respond well to pressure exerted on its mouth. Even though the present embodiment lacks the curb action produced by a bit, it still provides for adequate control of and communication with a horse. When used with a conventional headstall, the hackamore 80 is capable of simultaneously applying, at a gradually increasing rate, downward pressure through the nose band 34*c*, upward pressure through the curb strap 40*c* and downward pressure through the crownpiece of a headstall when the reins are progressively tightened. When pressure is applied at these three pressure points, the horse is encouraged to lower its head and flex at the poll. Thus, if a horse is responding to command signals to the satisfaction of the rider, using a hackamore embodying the invention, a bridle bit embodying the invention may not be required.

Whether the invention is embodied in a bridle bit or hackamore, its advantages in communication with and control of a horse will be apparent. Furthermore, the continuous nose band and curb strap loop, slidable through the purchase portions of the cheek pieces, provides a bridle bit or hackamore that can be easily adjusted to fit any horse, and that, once fitted to a given horse, will be self-adjusting to apply simultaneous, even pressure through the nose band and curb strap. Moreover, when combined with a mouthpiece and/or headstall, the invention provides an effective means for applying simultaneous control pressure at additional pressure points as well.

Having illustrated and described several different embodiments of the invention, it should be apparent to those skilled in the art that the invention may be modified in arrangement and detail. We claim as our invention all such modifications as come within the true spirit and scope of the following claims

We claim:

1. A control device for a horse comprising:

a pair of cheek pieces each including a rein ring on a lower portion of the piece and a headstall ring on an upper portion of the piece;

a nose band;

a curb strap;

the nose band and curb strap being connected at their ends to form a continuous, endless loop; and said loop being slidably connected to the cheek pieces adjacent the upper portions thereof.

2. A control device according to claim 1 wherein a mouthpiece is connected at its opposite ends to the cheek pieces between the rein rings and the headstall rings.

3. The control device of claim 2 wherein the cheek pieces each include a cheek ring between the rein ring and the headstall ring, and the mouthpiece is slidably connected at its opposite ends to the cheek rings.

4. The control device of claim 3 wherein each cheek ring includes a stop projection on a forward portion of the ring, and the mouthpiece is connected to a forward portion of the cheek ring below the stop projection so that the stop projection limits upward sliding movement of the mouthpiece on the cheek ring.

5. The control device of claim,,1 wherein each cheek piece includes an upper purchase portion including the headstall ring, and a lower shank portion including the rein ring.

6. The control device of claim 1 wherein each cheek piece includes a slide ring on an upper portion thereof for slidably receiving the loop.

7. The control device of claim 1 wherein each cheek piece includes a pair of slide rings on an upper portion thereof, said loop being slidably connected to each cheek piece through said pair of slide rings.

8. The control device of claim 7 wherein one of said pair of slide rings is positioned on its said cheek piece above the other slide ring of the pair.

9. The control device of claim 7 wherein one of said slide rings of a pair is positioned on the headstall ring and the other slide ring of the pair is positioned adjacent to the headstall ring and below the one slide ring.

10. The control device of claim 6 wherein the slide rings project laterally outwardly from their cheek pieces.

11. The control device of claim 1 wherein the loop is slidably connected to the cheek pieces such that when the device is connected to a bridle with reins and a headstall, and is installed on a horse's head, the nose band is positioned lower on the muzzle of the horse than the curb strap, whereby application of rein tension applies torque to the muzzle tending to lower the horse's head.

12. The control device of claim 1 wherein each cheek piece includes an upper purchase portion with the headstall ring being at the upper terminus of the purchase portion, and wherein the purchase portion includes a pair of slide rings including an upper slide ring positioned on an upper rearward portion of the headstall ring and a lower slide ring positioned below the headstall ring and below and forwardly of the upper slide ring, the noseband portion of the loop being threaded through the lower slide ring and through the upper slide ring and being connected to the curb strap portion of the loop rearwardly of the upper slide ring such that the nose band is positioned below the curb strap when the control device is fitted on a horse's muzzle.

13. The control device of claim 1 wherein the loop is adjustable in size to properly fit the heads of different horses.

14. A bridle bit comprising:

left and right cheek rings residing closely adjacent the cheeks of a horse when the bridle is placed on the horse's head, each cheek ring having an upper circumferential portion and a lower circumferential portion;

a shank member extending downwardly from a lower circumferential portion of each cheek ring;

a rein ring on the lower end of each shank member for connecting a rein;

a stop mounted forwardly on each cheek ring and positioned proximate the upper surface of a plane defined by the mouth of a horse;

a mouthpiece adapted to be received in the mouth of a horse, the mouthpiece having laterally extending first and second end portions each slidably connected to one of the cheek rings between the stop and shank member whereby relative sliding movement of the ends of the mouthpiece are prevented when rein tension is applied and whereby the ends of the mouthpiece are slidable between the stop and shank member when rein tension is released;

a purchase member extending upwardly from an upper circumferential portion of each cheek ring;

each purchase member including a headstall ring for connecting a headstall, a lower slide ring positioned below the headstall ring, and an upper slide ring positioned on the periphery of each headstall ring above and rearwardly of the lower slide ring;

a nose band for extending over the horse's nose, the nose band having opposite end portions; and an adjustable curb strap for extending under a horse's chin, the curb strap having opposite end portions connected to the opposite end portions of the nose band, thereby forming a continuous loop that slidably extends through the lower and upper slide rings of each purchase member.

15. The bridle bit of claim 14wherein the upper and lower slide rings extend outwardly from the purchase member.

16. The bridle bit of claim 15 wherein the nose band portion of the loop extends through the lower and upper slide rings.

17. A control device for a horse comprising:

rigid right and left cheek pieces for residing closely adjacent to the cheeks of a horse when the cheek pieces are part of a bridle placed on the horse's head;

at least one slide ring mounted on each cheek piece;

a nose band for extending over the horse's nose, the nose band having opposite end portions; and a curb strap for extending under a horse's chin, the curb strap having opposite end portions connected to the opposite end portions of the nose band, thereby forming a continuous loop that slidably extends through at least one slide ring of each cheek piece.

18. A control device according to claim 17, wherein each cheek piece has an upwardly extending purchase member having a headstall ring for connecting a headstall.

19. A control device according to claim 18, wherein the slide ring includes an upper slide ring and a lower slide ring on each cheek piece, the lower slide ring being mounted below the headstall ring, and the upper slide ring being mounted on the periphery of the headstall ring.

20. A control device according to claim 19, wherein each cheek piece has a downwardly extending shank member having a rein ring at its lower end for connecting a rein.

21. The bridle according to claim 17, wherein the loop has an adjustment means for adjusting the size of the loop to fit the muzzle of a horse.

22. The control device of claim 1 wherein the circumference of the loop remains substantially constant when the device is installed on a horse's head with a rein connected to each rein ring and rein tension is applied.

23. A control device for a horse comprising:

a pair of cheek pieces each including a rein ring connected to a lower portion of the piece and a headstall ring connected to an upper portion of the piece;

a nose band;

a curb strap;

the nose band and curb strap being connected at their ends to form a continuous loop; and said loop being slidable connected to the cheek pieces, wherein when the device is installed on a horse's head with a rein connected to each rein ring, the application of rein tension causes the nose band and curb strap to apply simultaneous pressure to the horse's muzzle.

* * * * *